US011303081B2

(12) United States Patent
Chen et al.

(10) Patent No.: US 11,303,081 B2
(45) Date of Patent: Apr. 12, 2022

(54) POWER ADAPTER AND ELECTRONIC DEVICE COMPRISING THE POWER ADAPTER

(71) Applicant: Delta Electronics (Shanghai) Co., Ltd., Shanghai (CN)

(72) Inventors: Xiaojun Chen, Shanghai (CN); Jinfa Zhang, Shanghai (CN); Daofei Xu, Shanghai (CN)

(73) Assignee: Delta Electronics (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 16/013,922

(22) Filed: Jun. 20, 2018

(65) Prior Publication Data

US 2019/0013633 A1 Jan. 10, 2019

(30) Foreign Application Priority Data

Jul. 5, 2017 (CN) ..... 201720804759.4

(51) Int. Cl.

| | |
|---|---|
| ***H01R 33/94*** | (2006.01) |
| ***H01R 33/06*** | (2006.01) |
| ***H01R 13/50*** | (2006.01) |
| ***H01R 24/68*** | (2011.01) |
| ***H01R 103/00*** | (2006.01) |

(52) U.S. Cl.

CPC ..... *H01R 33/94* (2013.01); *H01R 13/50* (2013.01); *H01R 24/68* (2013.01); *H01R 33/06* (2013.01); *H01R 2103/00* (2013.01)

(58) Field of Classification Search

CPC ..... H01R 33/94; H01R 33/06; H01R 24/68; H01R 13/50; H01R 25/003; H01R 43/18; H01R 13/652

USPC ..... 439/628

See application file for complete search history.

(56) References Cited

U.S. PATENT DOCUMENTS

| | | | | |
|---|---|---|---|---|
| 5,452,807 | A * | 9/1995 | Foster | A61G 13/107 211/168 |
| 5,921,795 | A * | 7/1999 | Weener | A47B 21/06 174/497 |
| 10,263,373 | B2 * | 4/2019 | Byrne | H02J 7/00 |
| 10,468,840 | B2 * | 11/2019 | Schaub | H01R 13/52 |
| 2004/0014339 | A1 * | 1/2004 | Machado | H01R 13/652 439/105 |
| 2011/0197794 | A1 * | 8/2011 | Nunes | B65H 75/36 108/50.02 |
| 2012/0289081 | A1 * | 11/2012 | Izzard | H01R 25/003 439/535 |
| 2015/0028684 | A1 * | 1/2015 | Harrison | H02J 1/00 307/82 |

(Continued)

FOREIGN PATENT DOCUMENTS

| | | | |
|---|---|---|---|
| CN | 106229733 | A | 12/2016 |
| KR | 1020140086413 | A | 7/2014 |

*Primary Examiner* — Jean F Duverne

(74) *Attorney, Agent, or Firm* — CKC & Partners Co., LLC

(57) ABSTRACT

The present invention discloses a power adapter and an electronic device comprising the same. The power adapter comprises a housing, which has a plurality of end faces. The power adapter further comprises a power inlet socket, which is provided on any of the plurality of end faces. The end face on which the power inlet socket is provided, at least another one of the plurality of end faces, and the power inlet socket are formed as one body integrally.

8 Claims, 4 Drawing Sheets

(56) References Cited

U.S. PATENT DOCUMENTS

| | | | | |
|---|---|---|---|---|
| 2016/0056600 | A1* | 2/2016 | Liao | H01R 35/04<br>439/131 |
| 2017/0351479 | A1* | 12/2017 | Trejo | G06F 3/162 |
| 2018/0287326 | A1* | 10/2018 | Tang | H01R 43/18 |

* cited by examiner

POWER ADAPTER AND ELECTRONIC DEVICE COMPRISING THE POWER ADAPTER

CROSS-REFERENCE TO RELATED APPLICATIONS

This non-provisional application claims priority under 35 U.S.C. § 119(a) on Patent Application No. 201720804759.4 filed in P.R. China on Jul. 5, 2017, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

TECHNICAL FIELD

The present invention relates to a power adapter; specifically, it particularly relates to a power adapter which has reduced internal space.

BACKGROUND ART

Nowadays, with the rapid development of science and technology, more and more miniaturized electronic devices have been developed, and power adapters are indispensable parts to many electronic devices.

At present, the power inlet sockets of the power adapters are mostly independent structures. More specifically, the power adapter needs an assembly structure to fix the power inlet socket to a housing of the power adapter, such as a card slot. Moreover, since the strength of the power adapter is required to be high, more auxiliary elements in the assembly structure is needed to meet the safety requirement. That is to say, the power adapter needs be designed to have more space in order to meet the safety requirement, and it goes against product miniaturization. Therefore, it is necessary to develop a power adapter which does not have the above-mentioned defects.

DISCLOSURE OF THE PRESENT INVENTION

The technical problem to be solved by the present invention is to provide a power adapter comprising a housing having a plurality of end faces and a power inlet socket which is provided on any one of the plurality of end faces, wherein the end face on which the power inlet socket is provided, at least another one of the plurality of end faces, and the power inlet socket are formed as one body integrally.

The Present Invention Further Provides an Electronic Device, Comprising:

an electronic device body;

the power adapter as described above, the power adapter being electrically connected to the electronic device body.

EMBODIMENTS

The details and technical description of the present invention will now be further described with reference to the preferred embodiments, which, however, should not be construed as limiting the implementation of the present invention.

Figure 1:
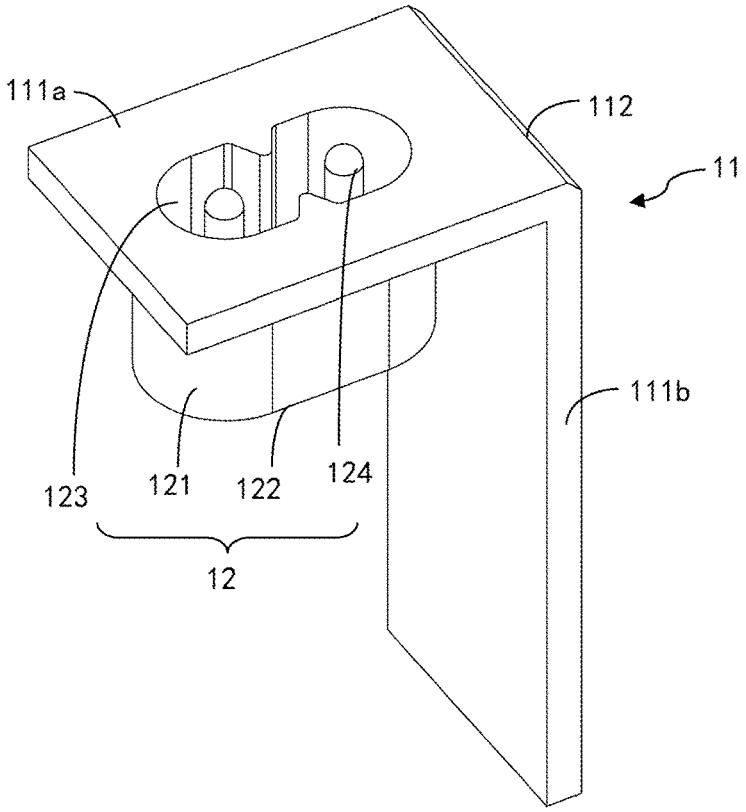
FIG. 1 is a schematic view of a first embodiment of the power adapter of the present invention.

Please refer to FIG. 1, which is a schematic view of a first embodiment of the power adapter of the present invention. The power adapter of the present invention comprises a housing 11 having a plurality of end faces, though only two of the end faces are shown in FIG. 1, the present invention is not limited thereto. The power adapter further comprises a power inlet socket 12, provided on any of the plurality of end faces, and the end face on which the power inlet socket 12 is provided, at least another one of the plurality of end faces and the power inlet socket 12 are formed as one body integrally.

In the structure of the power adapter shown in FIG. 1, the plurality of end faces of the housing 11 comprise a first end face 111*a* and a second end face 111*b* which are connected in an L shape, the power inlet socket 12 is provided on the first end face 111*a*, and the power inlet socket 12, the first end face 111*a* and the second end face 111*b* are formed as one body integrally. But, the present invention is not limited thereto, and in other embodiments, the power inlet socket 12 may be provided on the second end face 111*b*.

Further, at least a portion of the first end face 111*a* is recessed inwardly and extends to form a side wall 121 and a bottom 122 of the power inlet socket 12, the side wall 121 and the bottom 122 form an enclosure used as a pin hole 123 for the power inlet socket 12; the power inlet socket 12 further comprises two pins 124 which are located within the pin hole 123 and are mounted on the bottom 122; however, the number of pins is not limited in the present invention, and, in some other embodiments, the power inlet socket 12 may also comprise three pins. In the present embodiment, a transition surface 112 may be further connected between the first end face 111*a* and the second end face 111*b* in order to enhance the reliability of the integrated structure. Referring to FIG. 1, the transition surface 112 is an oblique cut surface, and in other embodiments, the transition surface 112 may also be an arc surface or the like, but the present invention is not limited thereto.

Figure 2:
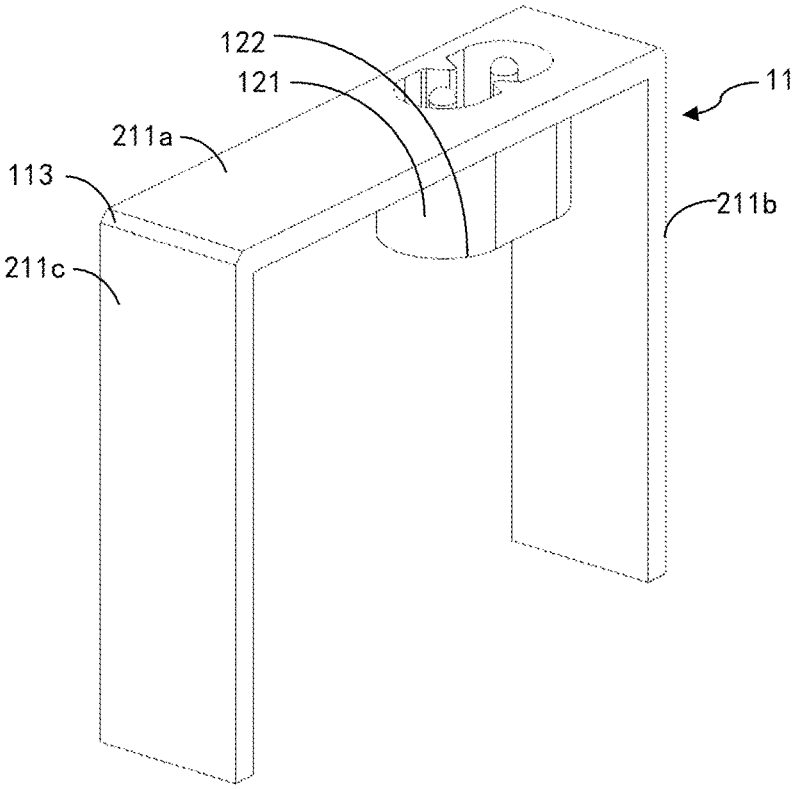
FIG. 2 is a schematic view of a second embodiment of the power adapter of the present invention.

Please refer to FIG. 2, which is a schematic view of a second embodiment of the power adapter of the present invention. As shown in FIG. 2, the plurality of end faces of the housing 11 comprise a first end face 211*a*, a second end face 211*b* and a third end face 211*c* connected in a U shape, the power inlet socket 12 is provided on the first end face 211*a*, and the power inlet socket 12, the first end face 211*a*, the second end face 211*b* and the third end face 211*c* are formed as one body integrally. It is to be noted that, in the present embodiment, the power inlet socket 12 is provided on the first end face 211*a*, but the present invention is not limited thereto. In other embodiments, the power inlet socket 12 may also be provided on the third end face 211*c* or the second end face 211*b*. The structure of the power inlet socket 12 is the same as that of the power inlet socket 12 shown in FIG. 1, and the details will not be described here. Further, in order to enhance the reliability of the integrated structure, a transition surface 113 is provided between the third end surface 211*c* and the first end surface 211*a* and between the first end surface 211*a* and the second end surface 211*b*, respectively. In the present embodiment, the transition surface 113 is an oblique cut surface, but the present invention is not limited thereto.

Figure 3:
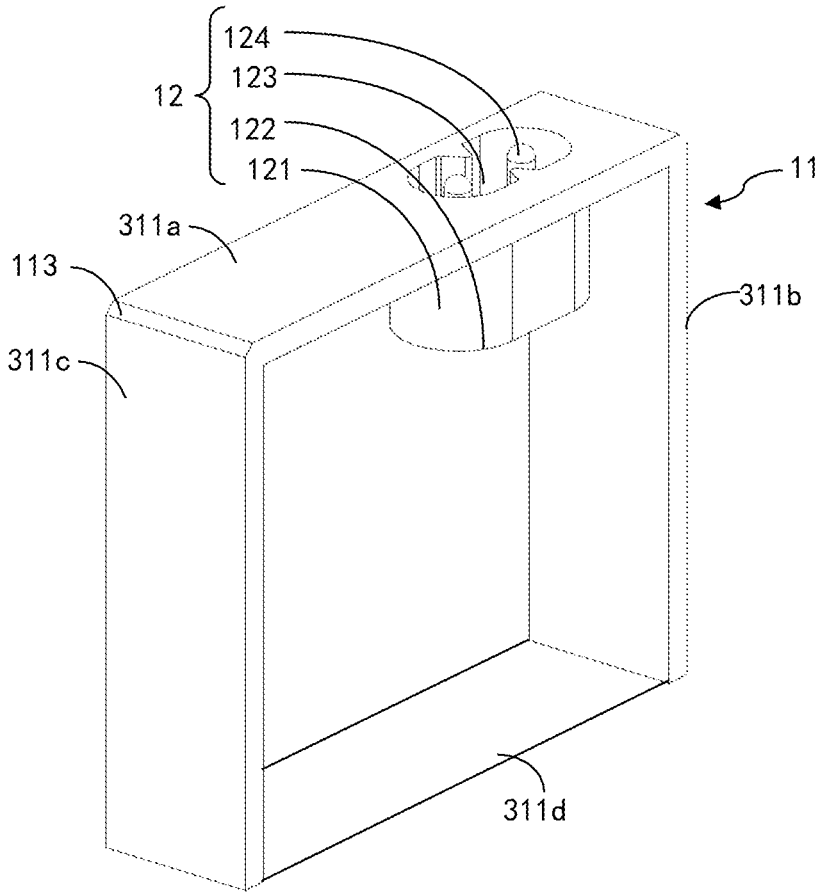
FIG. 3 is a schematic view of a third embodiment of the power adapter of the present invention.

Please refer to FIG. 3, which is a schematic view of a third embodiment of the power adapter of the present invention. As shown in FIG. 3, the plurality of end faces of the housing 11 comprise a first end face 311*a*, a second end face 311*b*, a third end face 311*c* and a fourth end face 311*d* which are connected to form an enclosure structure, the power inlet socket 12 is provided on the first end face 311*a*, and the power inlet socket 12, the first end face 311*a*, the second end face 311*b*, the third end face 311*c*, and the fourth end face 311*d* are formed as one body integrally. It is to be noted that, in the present embodiment, the power inlet socket 12 is provided on the first end face 311*a*, but the present invention is not limited thereto. In other embodiments, the power inlet socket 12 may also be provided at the third end face 311*c*, the second end face 311*b*, or the fourth end face 311*d*. The structure of the power inlet socket 12 is the same as that of the power inlet socket 12 shown in FIG. 1, and the details will not be described here.

Further, in order to enhance the reliability of the integrated structure, a transition surface 113 is provided at the joint among the first end surface 311*a*, the second end surface 311*b*, and the third end surface 311*c*, wherein in the present embodiment, the transition surface 113 is an oblique cut surface.

Figure 4:
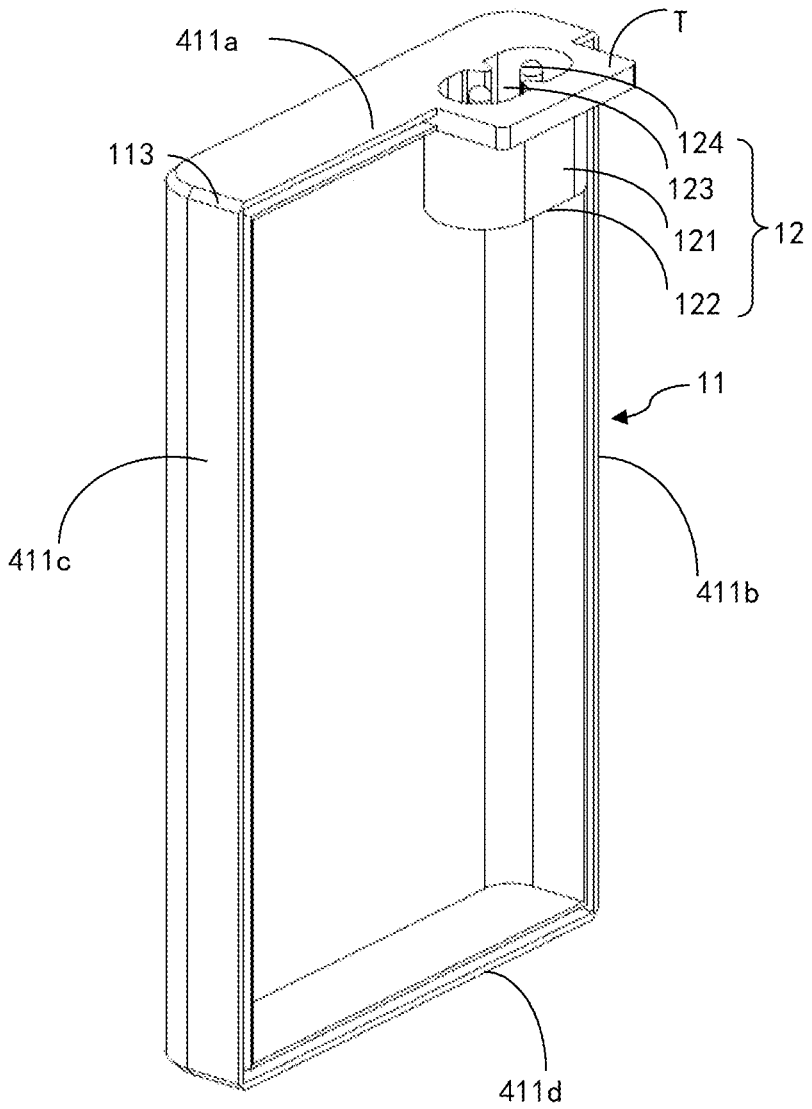
FIG. 4 is a schematic view of a fourth embodiment of the power adapter of the present invention.

Please refer to FIG. 4, which is a schematic view of a fourth embodiment of the power adapter of the present invention. The structure of the power adapter shown in FIG. 4 is substantially the same as that of the power adapter shown in FIG. 3, and therefore the same parts will not be described here. The difference between them is set forth as follows: the first end face 411*a* comprise a protrusion T extending upwardly, and at least a portion of the power inlet socket 12 is provided on the protrusion T. But, the present invention is not limited thereto. In other embodiments, the protrusion T may be provided on the third end face 411*c*, the second end face 111*b* or the fourth end face 111*d*.

Figure 5:
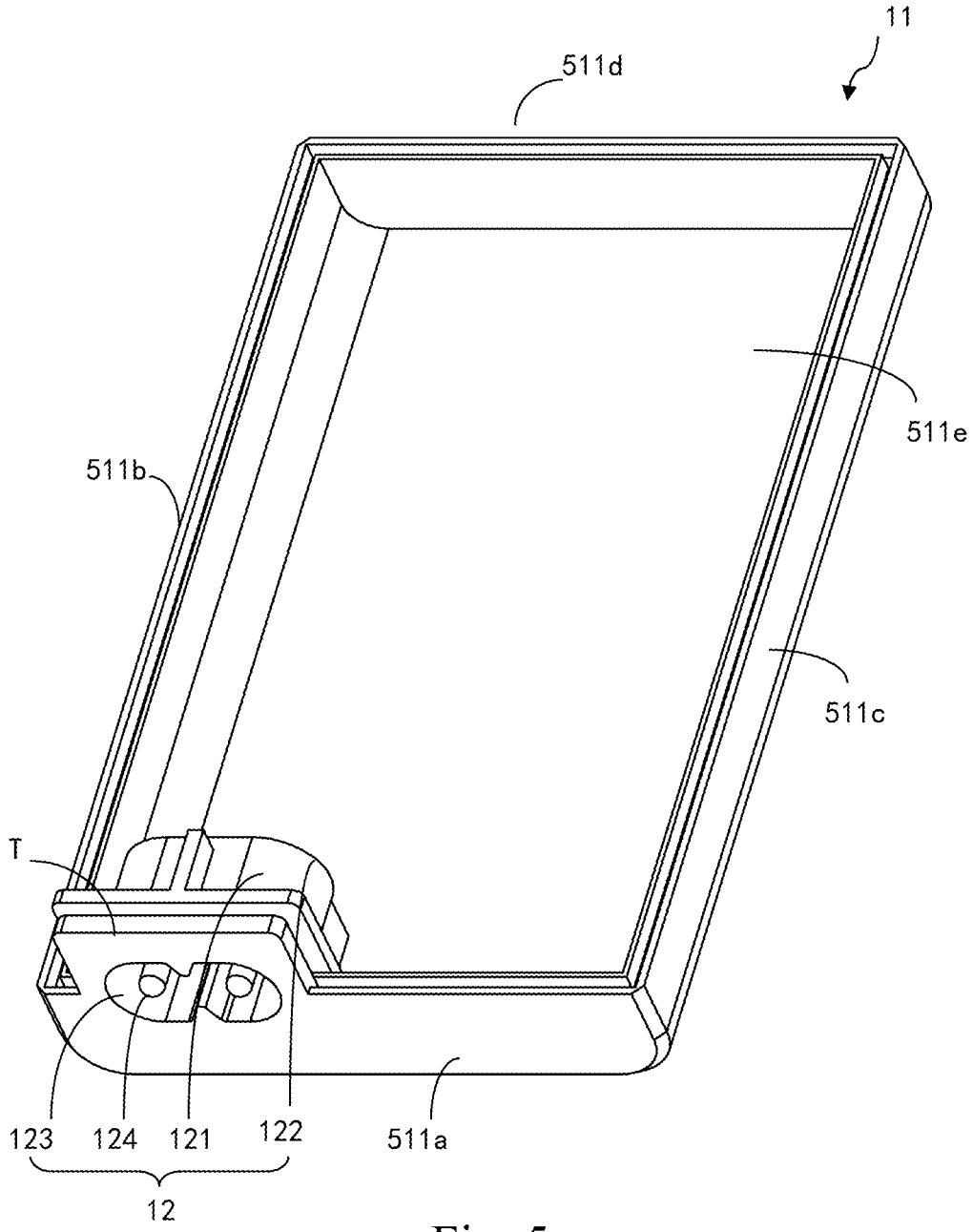
FIG. 5 is a schematic view of a fifth embodiment of the power adapter of the present invention.

Please refer to FIG. 5, which is a schematic view of a fifth embodiment of the power adapter of the present invention. The structure of the power adapter shown in FIG. 5 is substantially the same as that of the power adapter shown in FIG. 4, and therefore the same parts will not be described here. The difference between them is set forth as follows: the plurality of end faces of the housing 11 further comprise a fifth end face 511*e* connected to the bottoms of the first end face 511*a*, the second end face 511*b*, the third end face 511*c* and the fourth end face 511*d*, the power inlet socket 12 is provided on the first end face 511*a*, and the power inlet socket 12, the first end face 511*a*, the second end face 511*b*, the third end face 511*c*, the fourth end face 511*d*, and the fifth end face 511*e* are formed as one body integrally. In the present embodiment, the power inlet socket 12 is provided on the first end surface 511*a*, but the present invention is not limited thereto. In other embodiments, the power inlet socket 12 may also be provided on the third end face 511*c*, the second end face 511*b*, the fourth end face 511*d*, or the fifth end face 511*e*. The structure of the power inlet socket 12 is the same as that of the power inlet socket 12 shown in FIG. 1, and the details will not be described here.

It is to be noted that, in the present embodiment, the fifth end face 511*e* is connected to the bottoms of the first end face 511*a*, the second end face 511*b*, the third end face 511*c*, and the fourth end face 511*d*. In another embodiment of the present invention, the fifth end face 511*e* may be connected to the tops of the first end face 511*a*, the second end face 511*b*, the third end face 511*c*, and the fourth end face 511*d*.

Further, the first end face 511*a* comprise a protrusion T extending upwardly, and at least a portion of the power inlet socket 12 is provided on the protrusion T. But, the present invention is not limited thereto. In other embodiments, the protrusion T may be provided on the third end face 511*c*, the second end face 511*b*, or the fourth end surface 511*d*.

The present invention further provides an electronic device comprising: an electronic device body and a power adapter, the power adapter being electrically connected to the electronic device body, wherein the specific structure of the power adapter is the same as that of the power adapter shown in FIGS. 1-5, and the details will not be described here.

In summary, by forming the power inlet socket and at least two end faces of the housing as one body integrally in a power adapter, the assembly structure between the power inlet socket and the housing is omitted, thereby reducing the assembly space inside the housing of the power adapter, and miniaturizing the power adapter while enhancing the reliability of the power adapter.

The above are only the preferred embodiments of the present invention and are not used to limit the scope of the present invention. Without departing from the spirit and substance of the present invention, it is appreciated that those skilled in the art can make all kinds of corresponding changes and modifications according to the present invention, but these corresponding changes and modifications all should fall within the protection scope of the claims appended to the present invention.

What is claimed is:

1. A power adapter, comprising:

a housing having a plurality of end faces, wherein the plurality of end faces comprise a first end face and a second end face; and a power inlet socket provided on the first end face, wherein at least a portion of the first end face is recessed and extends to form the power inlet socket;

wherein the first and second end faces are arranged at an angle greater than 0° and less than 180° with each other, and wherein the first end face, the second end face, and the power inlet socket are formed as one body integrally, wherein the portion of the first end face on which the power inlet socket is provided is recessed and extends to form a side wall and a bottom of the power inlet socket, wherein the side wall and the bottom of the power inlet socket form an enclosure used as a pin hole of the power inlet socket; and wherein the power inlet socket further comprises two or three pins disposed within the pin hole of the power inlet socket and mounted on the bottom of the power inlet socket.

2. The power adapter according to claim 1, wherein the first end face and the second end face are arranged in an L shape.

3. The power adapter according to claim 1, wherein the plurality of end faces further comprise a third end face connected, wherein the first end face, the second end face, and the third end face are in a U shape; and wherein the power inlet socket, the first end face, the second end face and the third end face are formed as one body integrally.

4. The power adapter according to claim 1, wherein the plurality of end faces further comprise a third end face and a fourth end face, wherein the first end face, the second end face, the third end face, and the fourth end face are connected to form an enclosure structure; and wherein the power inlet socket, the first end face, the second end face, the third end face and the fourth end face are formed as one body integrally.

5. An electronic device, comprising:

an electronic device body; and a power adapter electrically connected to the electronic device body, the power adapter comprises:

a housing having a plurality of end faces, wherein the plurality of end faces comprise a first end face and a second end face; and a power inlet socket provided on the first end face, wherein at least a portion of the first end face is recessed and extends to form the power inlet socket;

wherein the first and second end faces are arranged at an angle greater than 0° and less than 180° with each other, and wherein the first end face, the second end face, and the power inlet socket are formed as one body integrally, wherein the portion of the first end face on which the power inlet socket is provided is recessed and extends to form a side wall and a bottom of the power inlet socket, wherein the side wall and the bottom of the power inlet socket form an enclosure used as a pin hole of the power inlet socket; and wherein the power inlet socket further comprises two or three pins disposed within the pin hole of the power inlet socket and mounted on the bottom of the power inlet socket.

6. The electronic device according to claim 5, wherein the first end face and the second end face are arranged in an L shape.

7. The electronic device according to claim 5, wherein the plurality of end faces further a third end face, wherein the first end face, the second end face, and the third end face are connected in a U shape; and wherein the power inlet socket, the first end face, the second end face and the third end face are formed as one body integrally.

8. The electronic device according to claim 5, wherein the plurality of end faces further comprise a third end face and a fourth end face, wherein the first end face, the second end face, the third end face, and the fourth end face are connected to form an enclosure structure; and wherein the power inlet socket, the first end face, the second end face, the third end face and the fourth end face are formed as one body integrally.

* * * * *